United States Patent [19]

Heine

[11] 4,203,175

[45] May 20, 1980

[54] SLIPPER HOLDER

[76] Inventor: Charles A. Heine, 730 Vera Dr., Arnold, Mo. 63010

[21] Appl. No.: 940,725

[22] Filed: Sep. 8, 1978

[51] Int. Cl.[2] ..... A47B 53/00; A43D 5/00

[52] U.S. Cl. ..... 5/503; 5/424; 248/215; 211/34

[58] Field of Search ..... 211/34, 35; 248/214, 248/215, 247, 248, 300, 340; 5/425, 426, 429, 503

[56] References Cited

U.S. PATENT DOCUMENTS

| | | | |
|---|---|---|---|
| 1,441,913 | 1/1923 | Darling | 248/215 |
| 2,074,736 | 3/1937 | Whitten | 248/214 |
| 2,614,268 | 10/1952 | Davies | 211/34 |
| 2,673,650 | 3/1954 | Olson | 211/35 |
| 3,172,537 | 3/1965 | Kraft | 211/35 |
| 3,602,979 | 9/1971 | Murcott | 5/429 |

*Primary Examiner*—Casmir A. Nunberg
*Attorney, Agent, or Firm*—Cohn, Powell & Hind

[57] ABSTRACT

This slipper holder can be used with hospital beds having round or square bed rails. The holder includes a body having an upper hook portion engageable with the upper rail and a lower portion bearing on the lower rail. A slipper support means is integrally formed on the body and provides a pair of upwardly extending fingers spaced from the body for receiving the slippers. The hook portion and the bearing portion cooperate to removably attach the holder to the bed rails.

3 Claims, 4 Drawing Figures

SLIPPER HOLDER

BACKGROUND OF THE INVENTION

This invention relates generally to slipper holders and particularly to a removable slipper holder which is used for hospital beds.

Hospital patients who undergo protracted stays in hospitals become acutely aware of the effort involved in leaving the bed by oneself in a weakened condition during convalescence. Even simple tasks are difficult and the locating of slippers, which may be on the floor or on a relatively distant chair, becomes a severe problem.

Slipper holders are known which are intended for use with hospital beds. For example, U.S. Pat. No. 2,614,268 discloses a hanger which is intended to hold the slippers horizontal. It is pivotable and attached to a bed rail in such a way that it can be swung under the bed. Unfortunately, this item is not particularly accessible and requires the manipulation of a thumb screw. Moreover, its attachment to the bed rail is not secure against rotation of the holder on the rail. Another patent, U.S. Pat. No. 2,114,441 discloses a wire rack which is attachable to a bed frame but the attachment is either by screws or by means of an upper wire hook only, which placed the lower portion of the holder under bending strain.

The present slipper holder solves the above and other problems in a manner not revealed by the known prior art.

SUMMARY OF THE INVENTION

This slipper holder is particularly useful in conjunction with hospital beds and provides a removable holder which is sufficiently sturdy to be readily secured to either round or square section bed rails and is thereby rendered readily accessible to a patient without strain and yet is sufficiently inexpensive as to be a disposable item issued to the patient upon admission to the hospital.

The holder is usable in connection with a hospital bed having upper and lower bed rails disposed in spaced relation from each other and the slipper holder includes a body having an upper portion extending rearwardly and downwardly to provide hook means engaging with the upper rail, said body including a lower rear engagement means disposed in spaced relation from the upper portion and bearing against the lower rail. The slipper holder also includes support means providing a pair of upwardly extending finger portions disposed in side-by-side relation connected to a portion of the body above the bearing portion.

The upwardly extending finger portions of the slipper support means and the downwardly depending portions of the hook means are substantially parallel with the lower portion of the body.

The body and the slipper support means are unitarily formed as by molding and the lower portion of the body is generally V-shaped and includes a plurality of transverse members connecting the arms thereof.

This slipper holder is inexpensive to manufacture and is relatively simple to use by a convalescing hospital patient.

DESCRIPTION OF THE PREFERRED EMBODIMENT

Figure 1:
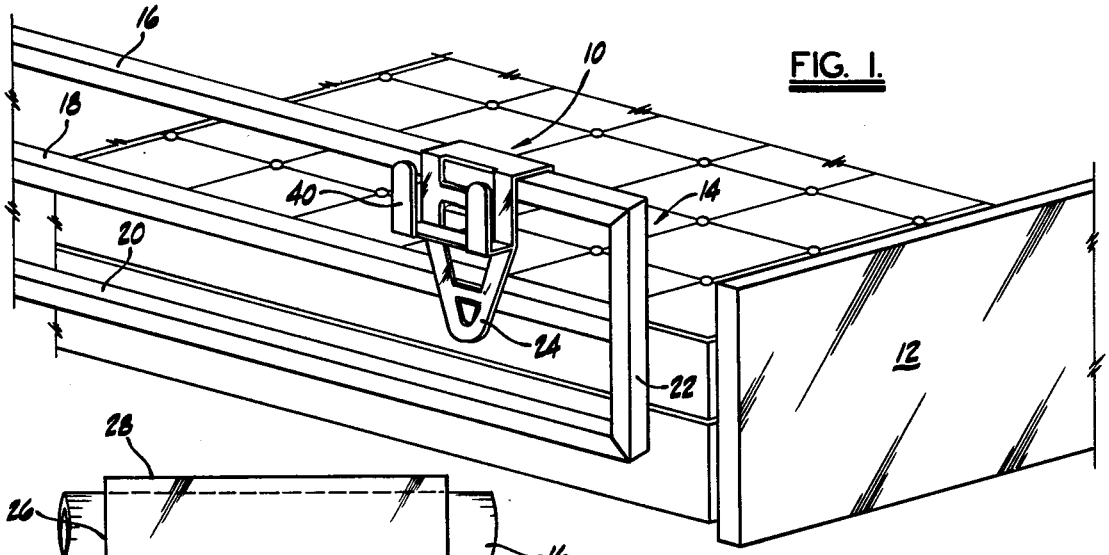
FIG. 1 is a perspective view of the slipper holder in position on a bed rail.
Figure 4:
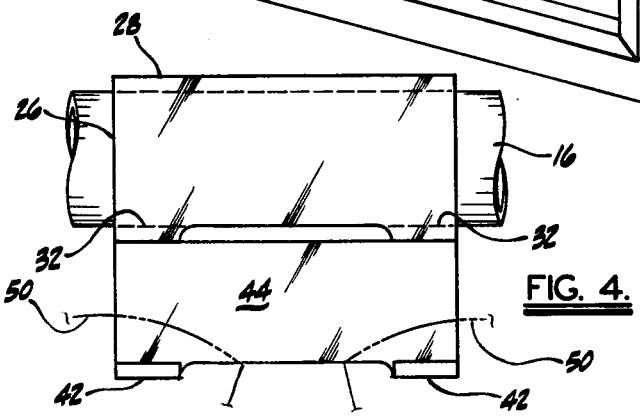
FIG. 4 is a top plan view thereof.
Figure 2:
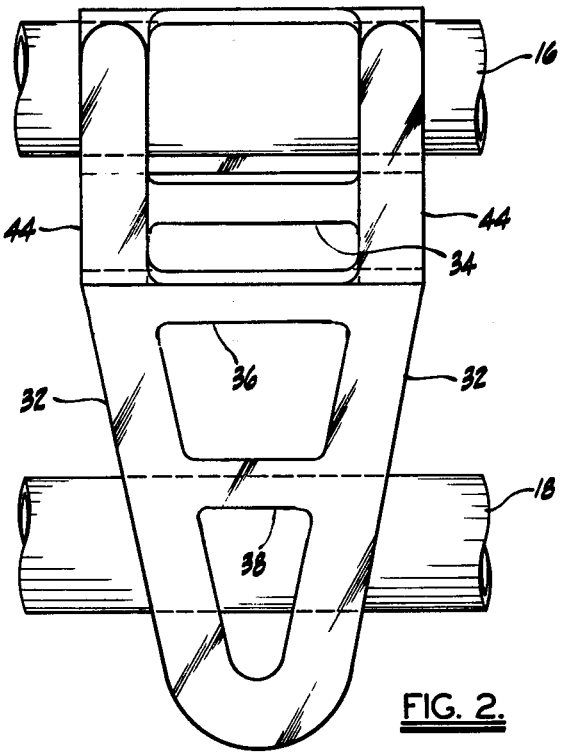
FIG. 2 is a front elevational view of the slipper holder.
Figure 3:
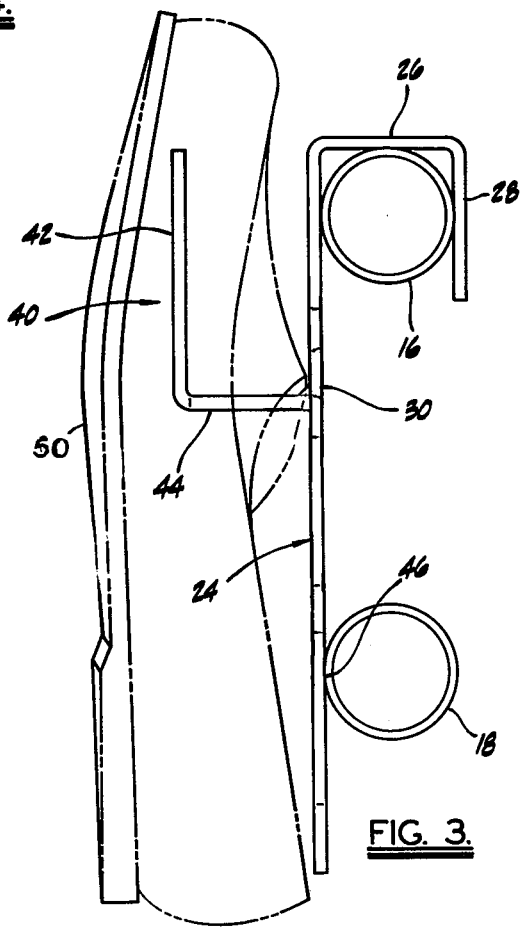
FIG. 3 is a side elevational view thereof.

Referring now by reference numerals to the drawing, and first to FIG. 1, it will be understood that the slipper holder, generally indicated by numeral 10, is shown in use with the side rail 14 of a hospital bed 12. The side rail 14 is typical in that it includes an upper rail 16 and lower rails 18 and 20 which are connected at their end by a vertical rail 22. The side rail 14 is attached to the bed 12 in such a manner that is can be moved to a storage position (not shown) and the rails can be of square tubular cross section as shown in FIG. 1 or round tubular cross section as shown in FIGS. 2 through 4. The construction of the slipper holder 10 is such that it is adapted to suit circular or square rails as will appear from the detailed description of the holder 10 which follows.

The slipper holder 10 of the preferred embodiment, as best shown in FIGS. 2–4, is unitarily formed, as by molding, and includes a body 24 having an upper portion providing a horizontal element 26 and a downwardly depending vertical element 28 cooperating to provide a hook means. The body also includes a downwardly depending portion 30, as shown in FIG. 2, consisting essentially of a pair of symmetrical arms 32 converging at their lower end and being interconnected by a plurality of transversely extending members 34, 36 and 38 interconnecting said arms 32.

A generally L-shaped slipper support means 40 is fixedly attached to the body 24, and includes a pair of finger portions 42 disposed in side-by-side relation and extending upwardly in substantially parallel relation to said arms 32 and said body depending portion 30. The finger portions 42 are received within the front portion of the slippers 50 and are connected to the body 24 by means of a forwardly extending platform portion 42 which, in the preferred embodiment is integrally formed with transverse stiffener 36.

The slipper support means 40 are connected to the slipper holder body 24 above the lower rail 18 and the weight of the slipper 50 tends to rotate the holder about the upper rail 16. This becomes particularly apparent in those instances in which the rails 16 and 18 are circular and the tendency to rotation is resisted by the extension of the body 24 below the lower rail 18 so that the rear face 46 engages the lower rail 18 in bearing relation. Thus, a structural arrangement of parts is created in which the body upper portion provides a substantially square hook means, frictionally engageable with either a square or round tubular rail, and the body lower portion provides a bearing means in spaced relation from the hook means, which results in a resistance, couple effect between said body and rail engagement. By this arrangement, the slipper holder 10 is secured to the bed rails without the need for fasteners and permits the slippers 50 to be removed with ease.

As shown in FIG. 4, the provision of a platform portion 44, which extends between the finger portions 42 not only strengthens the base of the fingers, but tends to cant the slippers 50 to one side thereby facilitating removal of the individual slippers.

I claim as my invention:

1. A slipper holder for a hospital bed including upper and lower spaced bed rails, comprising:

(a) an upper bed rail, (b) a lower bed rail disposed in spaced relation below said upper rail, (c) a unitary body including:

1. an upper portion having rearwardly extending and downwardly depending hook means engageable with said upper bed rail and freely, upwardly removable from said rail, and 2. a lower depending portion integrally formed with said upper portion and having a rear bearing means disposed in spaced relation from said upper portion and engageable with said lower bed rail, and (d) a slipper support means including a pair of spaced upwardly extending finger portions disposed in fixed side-by-side relation and means connecting said portions with said body portion above the bearing means.

2. A slipper holder as defined in claim 1, in which: the lower portion is generally V-shaped and includes a plurality of transverse members extending between and connecting the arms thereof.

3. A slipper holder for a hospital bed including upper and lower spaced bed rails of either square or circular cross section comprising:

(a) an upper bed rail, (b) a lower bed rail disposed in spaced relation below said upper rail, (c) a unitary body including:

1. an upper portion having rearwardly extending and downwardly depending hook means and downwardly extending portion being engageable with one side of the upper rail, and 2. A lower depending portion integrally formed with said upper portion and having a rear bearing means disposed in spaced relation from said upper portion said bearing means being engageable with the other side of the lower rail, and (d) a slipper support means including a pair of spaced upwardly extending finger portions disposed in fixed side-by-side relation and having means connecting said finger portions disposed vertically between the hook means and the rear bearing means said connecting means receiving the weight of the slippers at a point horizontally spaced outwardly from said rails whereby the weight of the slippers is distributed to both rails.

* * * * *